United States Patent [19]

Weiler

[11] 3,940,235

[45] Feb. 24, 1976

[54] IMMERSION FUSING

[75] Inventor: Ernest A. Weiler, Rochester, N.Y.

[73] Assignee: Xerox Corporation, Stamford, Conn.

[22] Filed: Aug. 26, 1974

[21] Appl. No.: 500,411

[52] U.S. Cl. ..... 432/8; 34/9; 118/402; 432/59

[51] Int. Cl.[2] ..... F26B 13/00; B05C 3/00

[58] Field of Search ..... 432/7–11, 5, 432/13, 42, 197, 198, 230.59, 22, 143, 178; 34/9, 41; 118/402, 403; 134/62, 63; 117/1.7

[56] References Cited

UNITED STATES PATENTS

| | | | |
|---|---|---|---|
| 1,560,589 | 11/1925 | Andrews et al. | 34/9 |
| 1,759,600 | 5/1930 | Wilshire | 34/9 |
| 2,197,145 | 4/1940 | Engle | 432/8 |
| 3,383,189 | 5/1968 | Sendzimir | 118/402 |
| 3,827,854 | 8/1974 | Gildersleeve | 432/8 |

*Primary Examiner*—John J. Camby
*Assistant Examiner*—Henry C. Yuen
*Attorney, Agent, or Firm*—Robert J. Bird

[57] ABSTRACT

Method and apparatus to heat fix a heat fusible xerographic powder image to a final support material in which the powder image is first transferred to a final support material and the image-bearing support material then brought into contact with a bath of hot liquid metal for a period of time sufficient to fix the image to the support material. The temperature of the bath is maintained at a temperature high enough to fuse the image but below that at which the support material is damaged. The liquid metal bath has floating on it a layer of molten non-metal to prevent oxidating of the metal and to precoat the support material on its entry into the bath to prevent particles of the liquid metal from embedding in the support material. The relative high density of the molten metal acts as a wringer to keep the plasticized coating very thin when drawn out of the bath.

3 Claims, 2 Drawing Figures

IMMERSION FUSING

BACKGROUND OF THE INVENTION

This invention relates to xerographic image fusing and, in particular, to apparatus and method for effecting image fixing by placing an image bearing support material in thermal contact with a bath of liquid metal.

In the process of xerography, a xerographic plate comprising a layer of photoconductive insulating material placed on a conductive backing is given a uniform electric charge over its surface. The charged photoconductor is then exposed to a light image of the subject matter to be reproduced thereby discharging the photoconductive plate in the areas of greatest radiation intensity to create an electrostatic latent image. The latent image is developed with an electrostatically charged finely divided powder or toner which is brought into contact with the photoconductive layer. The toner is electrostatically attracted to the image areas thus developing the latent image. Thereafter, the developed xerographic powder image is electrostatically transferred to a support material to which it is fixed to form a permanent copy. One way in which the toner image is fixed to the support material is by heat fusing. All of this is well known in the art.

One method of heat fusing a toner image is disclosed in U.S. patent application Ser. No. 459,863, filed Apr. 11, 1974 by Prafulla S. Dhoble. The full disclosure of the Dhoble application is incorporated herein by reference.

In brief, the Dhoble invention is of a method and apparatus for heat fusing a toner image by immersion of the support material and toner image in a hot liquid, including certain molten metals. Basically, the unfused toner image is driven on a web of paper through a bath of molten metal which fuses the toner to the paper. This is shown schematically in FIG. 1 of the drawing. While the liquid metal does not wet the paper, minute particles of the metal may get embedded in the paper or in the fused image. Furthermore, oxidation of the molten metal exposed to atmosphere is undesirable.

It is an object of this invention, therefore, to provide a method and apparatus for xerographic fusing by means of a liquid metal in which embedding of metal particles in the toner or in the support material is avoided.

Another object of this invention is to provide a method and apparatus for xerographic fusing by the application of liquid metal with means to prevent the metal from oxidizing.

Briefly, the salient features of this invention include xerographic fusing by moving a support material and an undeveloped zerographic image thereon through a liquid metal bath. A layer of molten plasticizer floats atop the liquid metal whereby paper flowing into the system is contacted and coated by the placticizer prior to contact with the liquid metal. The layer of plasticizer coats the entire copy and xerographic image to prevent particles of the liquid metal from attaching thereto, and also serves as an oxidation barrier for the liquid metal.

For a better understanding of this invention, reference is made to the following detailed description given in connection with the accompanying drawing.

DRAWINGS

DESCRIPTION

Figure 1:
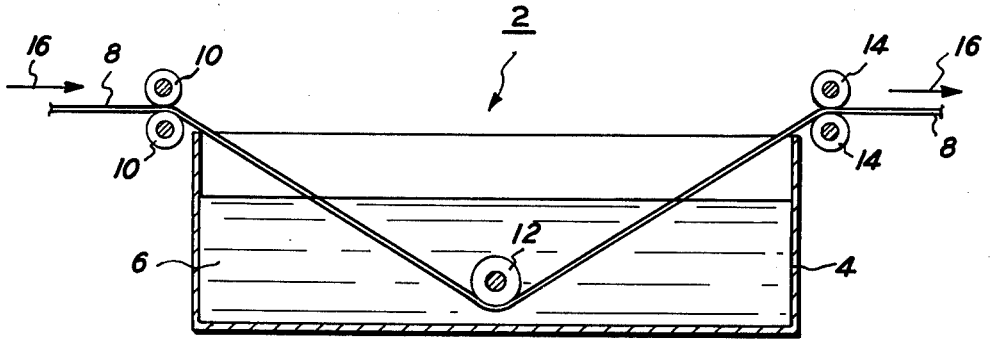
(PRIOR ART) FIG. 1
FIG. 1 is a schematic of prior art liquid metal fusing apparatus.

FIG. 1 shows schematically a prior art system of the type disclosed by Dhoble as discussed above. A liquid fusing apparatus is represented generally at 2 and includes a container 4 containing a bath of liquid or molten metal 6. A web of paper or other support material 8 is fed into the metal bath 6 by means of suitable guide rollers 10. A roller or other guide member 12 guides the web 8 through the metal bath 6, and guide rollers 14 direct the web 8 upon exit from the metal bath. The path 16 of the paper is represented by arrows 16 at the input and output sides of the system.

In operation, an unfused toner image borne by the paper 8 is moved into and through the molten metal bath. As a result of the heat derived from the molten metal, the toner is fused and thereby fixed to the paper prior to its delivery to a cutting and/or collecting station.

Figure 2:
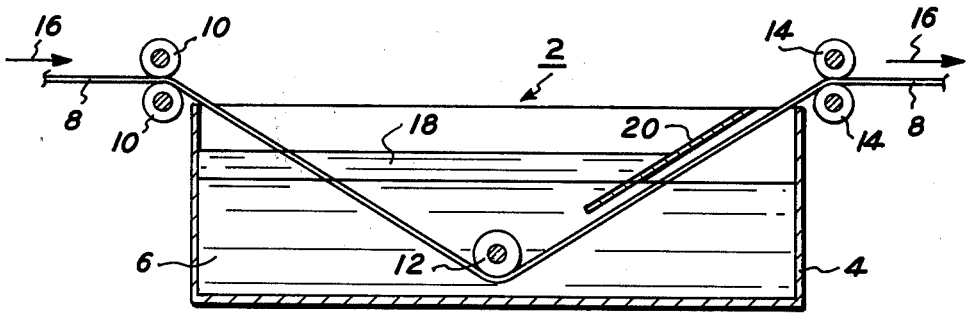
FIG. 2 is a schematic of a liquid metal fusing apparatus according to the present invention.

Referring now to FIG. 2, the present invention is represented with the same numbers representing the same elements as in FIG. 1. There is shown, in addition, a bath of molten plasticizer 18 floating atop the metal bath 6. The plasticizer material may be paraffin or a suitable high melting point wax. The particular material is not essential to the present invention.

A dam or baffle member 20 extends from one side to the other of the container 4 (that is toward and away from the reader from one to the other side of the container). Baffle 20 extends downwardly into the container to a level below the level of the liquid metal 6, and upwardly to a level above that of the plasticizer 18. The function of the baffle 20 is to keep the plasticizer in the paper inlet side of the container 4 and out of the paper outlet side. It is preferable in order to get maximum efficiency of the plasticizer as an oxidation barrier to have the plasticizer cover as much of the liquid metal where the paper 8 is drawn out. For this purpose, the baffle 20 is located as shown, fairly close to the paper 8 as it exits the system.

In operation, the paper 8 as it is introduced to the system is contacted and coated by the plasticizer 18 prior to the entry into the liuqid metal 6. The plasticizer thus coats the entire paper surface and toner image prevents embedding of metal particles in the paper or the toner image. The metal bath itself, because of its much greater density, acts as an efficient wringer which keeps the plasticizer coating very thin, whereby the paper 8 will have a thin glossy surface when it leaves the metal bath 6. For this last purpose, it is important to keep the plasticizer 18 away from the area where the paper 8 leaves the bath. Otherwise, a second coating of plasticizer would attach itself.

The foregoing description of an embodiment of this invention is given by way of illustration and not of limitation. The concept and scope of the invention are limited only by the following claims and equivalents thereof which may occur to others skilled in the art.

What is claimed is:

1. A method of heat fixing a heat fusible xerographic toner image to a final support material to which it has been applied in image configuration, including:

moving said support material into a hot molten bath of metal and liquid nonmetal in which the liquid nonmetal floats atop the metal in the area where the support material moves into the bath, said molten nonmetal forming an initial coating on said support material and forming a vapor and oxidation barrier over said molten metal, said molten bath of metal being sufficient in size and heat content to effect a thermal fixing of said toner image to said support material without degrading either said toner or said support material, and to effect a wringing of said initial coating of nonmetal, moving said support material out of said molten bath of metal in an area where floating molten nonmetal is not present, maintaining a floating cover of liquid nonmetal in the area where the support material moves into the bath, and maintaining a bath of metal uncovered by liquid nonmetal in the area where the support material exits the bath.

2. A method of making an electrostatically reproduced copy wherein thermo-responsive particulate material is arranged in a predetermined pattern on a support material, including:

contacting the suppport material with a body of liquid sufficient in size and heat content to effect a thermal fixing of said thermo-responsive particulate material without degrading said support material or said thermo-responsive particulate material, said body of liquid including a bath of hot liquid metal and a bath of liquid nonmetal floating atop said hot liquid metal in the area thereof wherein said support material is introduced, said liquid nonmetal forming an initial coating on said support material and forming a vapor and oxidation barrier over said liquid metal, said liquid metal effecting a wringing of said initial coating of nonmetal, maintaining said contact for a time sufficient to thermally fix said thermo-responsive material to said support material, maintaining a floating cover of nonmetal in the area where said support material moves into the bath, and maintaining a bath of liquid metal uncovered by liquid nonmetal in the area where said support material exits the bath.

3. A method of fixing a heat fusible particulate material to a support material to which it has been applied in imagewise configuration, and of coating said support material said configuration of particulate material with a nonmetallic plasticizer, including:

moving said support material into a molten bath of metal and nonmetal plasticizer in which said nonmetal plasticizer floats atop said metal in the area where said support material moves into said bath, the movement of said support material being in a direction so as to contact said plasticizer before said metal, said plasticizer forming a coating on said support material and forming a vapor and oxidation barrier over said molten metal, said molten bath of metal being sufficient in size and heat content to effect a thermal fixing of said particulate material to said support material, and to effect a wringing of said coating of plasticizer, moving said support material out of said molten bath of metal in an area where floating plasticizer is not present.

* * * * *